US007304611B2

(12) United States Patent
Yuanzhu

(10) Patent No.: US 7,304,611 B2
(45) Date of Patent: Dec. 4, 2007

(54) ANTENNA SYSTEM WITH HIGH GAIN FOR RADIO WAVES POLARIZED IN PARTICULAR DIRECTION

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 77 days.

(21) Appl. No.: 10/870,641

(22) Filed: Jun. 17, 2004

(65) Prior Publication Data

US 2004/0263400 A1 Dec. 30, 2004

(30) Foreign Application Priority Data

Jun. 26, 2003 (JP) ..... 2003-182957
Sep. 1, 2003 (JP) ..... 2003-308961

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/767–769, 343/846, 845, 702, 700 MS, 713
See application file for complete search history.

(56) References Cited

U.S. PATENT DOCUMENTS 4,386,357 A * 5/1983 Patton ..... 343/700 MS
4,672,386 A * 6/1987 Wood ..... 343/770
6,735,849 B2 * 5/2004 Cheng et al. ..... 29/600
6,750,825 B1 * 6/2004 Delaveaud et al. ..... 343/749
7,038,631 B2 * 5/2006 Jecko et al. ..... 343/767
2002/0050954 A1 * 5/2002 Jeong-Kun et al. ..... 343/770
2003/0016179 A1 * 1/2003 Boyle ..... 343/702

FOREIGN PATENT DOCUMENTS

JP A-08-213832 8/1996
JP A-10-093332 4/1998

* cited by examiner

*Primary Examiner*—Hoang V. Nguyen
(74) *Attorney, Agent, or Firm*—Brink Hofer Gilson & Lione

(57) ABSTRACT

In an antenna system, a short-circuiting conductive plate and a power-supply conductive plate are bent at the center region of a metal plate so as to be perpendicular to the planar surface of the metal plate. The remaining metal plate excluding the short-circuiting conductive plate and the power-supply conductive plate constitutes the emission conductive plate. The antenna system is mounted on a ground plane and the emission conductive plate is disposed parallel to the ground plane. The bottom end of the short-circuiting conductive plate is soldered to the ground plane and the bottom end of the power-supply conductive plate is connected to a power-supply circuit.

30 Claims, 6 Drawing Sheets

ANTENNA SYSTEM WITH HIGH GAIN FOR RADIO WAVES POLARIZED IN PARTICULAR DIRECTION

BACKGROUND OF THE INVENTION

1. Field of the Invention

An aspect of the present invention may relate to an antenna system which can be miniaturized with relative ease like an inverted F antenna, and more particularly to an antenna system that is suitably mounted on vehicles.

2. Description of the Related Art

Low-profile inverted F antennas with small dimensions are known. Various antenna systems including improved inverted F antennas have been proposed (see Japanese Unexamined Patent Application Publication No. Hei 10-93332, in particular, pages 2-3 and FIG. 1).

FIG. 11 is a perspective view of a known inverted F antenna. An inverted F antenna 1 composed of a metal plate is mounted on a ground plane 5. The inverted F antenna 1 includes an emission conductive plate 2, a power-supply conductive plate 3, and a short-circuiting conductive plate 4. The emission conductive plate 2 faces the ground plane 5 so that they are parallel to each other. The power-supply conductive plate 3 extends from an edge of the emission conductive plate 2 substantially perpendicular to the emission conductive plate 2 and is connected to a power-supply circuit (not shown). The short-circuiting conductive plate 4 extends from another edge of the emission conductive plate 2 substantially perpendicular to the emission conductive plate 2 and is connected to the ground plane 5. The power-supply conductive plate 3 and the short-circuiting conductive plate 4 are appropriately positioned relative to the emission conductive plate 2 for the best impedance matching. The longitudinal length of the emission conductive plate 2 in FIG. 11 is about one-fourth of the resonance length. The inverted F antenna 1 is easily fabricated by bending a metal plate, leading to reduced manufacturing costs.

Since inverted F antennas and improved inverted F antennas having small dimensions are inexpensively fabricated and also exhibit high gain as described above, they are generally used for vehicle-mounted antennas. Unfortunately, these known inverted F antennas and improved ones do not exhibit sufficiently high gain for vertical polarization, which is required for the vehicle-mounted antennas. With the known inverted F antennas and improved ones, when power is supplied, not only radio waves polarized orthogonal to the emission conductive plate, e.g., vertical polarization, but also radio waves polarized parallel to the emission conductive plate, e.g., horizontal polarization are emitted. Since these antennas have low polarization purity, the gain for radio waves polarized in a particular direction is reduced and thus the antennas cannot achieve desired high gain.

SUMMARY OF THE INVENTION

In order to mitigate problems associated with the known inverted F antennas and the improved inverted F antennas, a low-profile antenna system with small dimensions which can be fabricated at reduced cost while exhibiting high gain for radio waves polarized in a particular direction is described.

An aspect of an antenna system of the present invention includes a ground plane, an emission conductive member disposed substantially parallel to the ground plane, a short-circuiting conductive member having a first end and a second end, and a power-supply conductive member having a first end and a second end. The first end of the short-circuiting conductive member and the first end of the power-supply conductive member are connected to a center region of the emission conductive member. The second end of the short-circuiting conductive member is connected to the ground plane. The second end of the power-supply conductive member is connected to a power-supply circuit such as a radio transmitter, radio transceiver, or the like. In such an antenna system, an electric current is shunted in opposite directions at the center region of the emission conductive member when power is applied.

Electric fields generated by a current shunted in opposite directions at the center region of the emission conductive plate are canceled. Accordingly, hardly any radio waves polarized parallel to the emission conductive plate are emitted, whereas radio waves polarized orthogonal to the emission conductive plate are intensely emitted. Hence, the antenna system of the present invention has small dimensions like the inverted F antennas, while exhibiting higher polarization purity than the inverted F antennas. The antenna system has higher gain for radio waves polarized in a particular direction, for example, vertical polarization.

In such an antenna system, the short-circuiting conductive member and the power-supply conductive member may be disposed with a gap therebetween at the center region of the emission conductive member so that the antenna system has a pi ($\pi$) shape. Alternatively, the antenna system may include a common conductive member that is connected to the center region of the emission conductive member, and the first end of the short-circuiting conductive member and the first end of the power-supply conductive member may be connected to the common conductive member.

A bent portion may be provided on at least a part of the circumference of the emission conductive member, the direction of the bent portion being not parallel to that of the ground plane. When the bent portion is provided, the planar area of the emission conductive member is reduced and thus the antenna system may be further miniaturized.

The emission conductive plate of the antenna system may have a substantially symmetric meandering-shape with respect to the centerline, the emission conductive plate having a plurality of cut-out sections. With the meandering-shaped emission conductive plate, an electric current flows along the meander and thus the electrical length is longer, which may lead to further miniaturization.

The emission conductive member, the short-circuiting conductive member, and the power-supply conductive member of the antenna system are comprised of a metal plate or a conductive layer which is formed on a surface of an insulating base made of, e.g., synthetic resin. When the emission conductive member, the short-circuiting conductive member, and the power-supply conductive member are composed of a metal plate, bent segments provided at the center region of a single metal plate may function as the short-circuiting conductive member and the power-supply conductive member, and the remaining metal plate may function as the emission conductive member. Thus, costs for fabricating the antenna system may be reduced. Alternatively, the emission conductive member, the short-circuiting conductive member, and the power-supply conductive member may be comprised of two or three metal plates.

When the emission conductive member, the short-circuiting conductive member, and the power-supply conductive member are comprised of the conductive layer, the conductive layer, which serves as each of the conductive members, may be formed on the surface of the insulating base so that the antenna system is fabricated at reduced cost. Alternatively, the conductive layer may be formed on surfaces of two or three insulating substrates or support bases. Furthermore, the metal plate and the insulating base are connected, the insulating base including the conductive layer on a surface thereof, and the emission conductive member, the short-circuiting conductive member, and the power-supply conductive member may be comprised of the metal plate and the conductive layer.

The emission conductive member may be composed of the conductive layer which is formed on the surface of an insulating base, and the short-circuiting conductive member and the power-supply conductive member may be composed of conductive pins passing through the insulating base.

DESCRIPTION OF THE PREFERRED EMBODIMENTS

Figure 1:
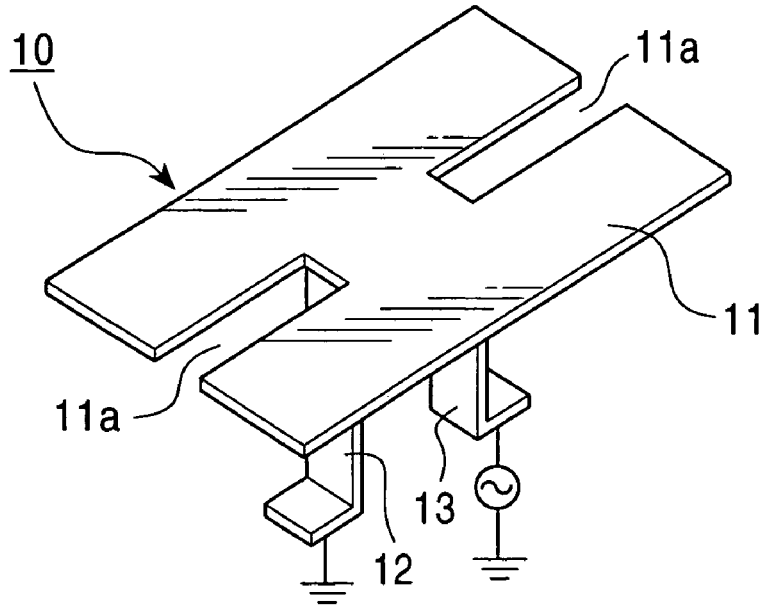
FIG. 1 is a perspective view of an antenna system according to a first embodiment of the present invention.
Figure 2:
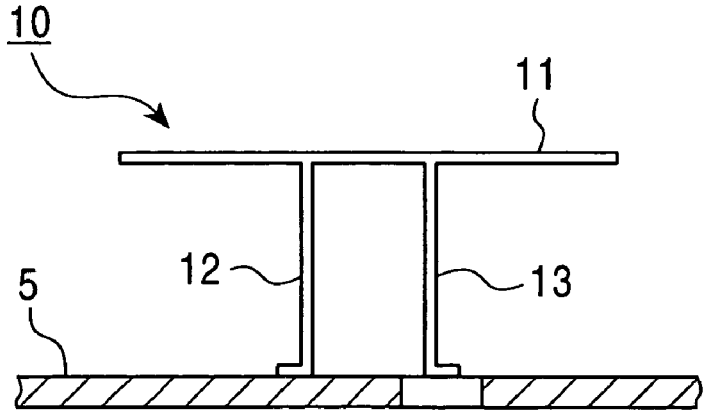
FIG. 2 is a side view of the antenna system illustrated in FIG. 1.

Aspects of the present invention will now be described with reference to the accompanying drawings. FIG. 1 is a perspective view of an antenna system according to a first embodiment. FIG. 2 is a side view of the antenna system.

An antenna system 10 shown in FIGS. 1 and 2 includes a short-circuiting conductive plate 12, a power-supply conductive plate 13 (or feed plate), and an emission conductive plate 11 which are made by bending a single metal plate. The short-circuiting conductive plate 12 and the power-supply conductive plate 13 are bent downward from the center region of the metal plate so as to be substantially perpendicular to the metal plate. The remaining metal plate excluding the short-circuiting conductive plate 12 and the power-supply conductive plate 13 is the emission conductive plate 11. More specifically, the emission conductive plate 11 has two cut-out portions 11*a* corresponding to the short-circuiting conductive plate 12 and the power-supply conductive plate 13. The cut-out portions 11*a* oppose each other with a gap therebetween at the center of the emission conductive plate 11. The antenna system 10 has a pi ($\pi$) shape when viewed from the side. As shown in FIG. 2, the antenna system 10 is mounted on the ground plane 5 so that the conductive plate 11 and the ground plane 5 are parallel to each other. The bottom end of the short-circuiting conductive plate 12 may be soldered to the ground plane 5 and the bottom end of the power-supply conductive plate 13 may be connected to the power-supply circuit or sensor (not shown). The short-circuiting conductive plate 12 and the power-supply conductive plate 13 protrude downward from the center region of the emission conductive plate 11. The short-circuiting conductive plate 12 and the power-supply conductive plate 13 are precisely positioned relative to the emission conductive plate 11 in order to facilitate impedance matching.

The positions of the short-circuiting conductive plate 12 and the power-supply conductive plate 13 relative to the emission conductive plate 11 are very different from those of the known inverted F antennas, and the antenna system 10 may exhibit superior polarization purity. More specifically, with the antenna system 10, since the short-circuiting conductive plate 12 and the power-supply conductive plate 13 are disposed in the center region of the emission conductive plate 11, electric fields generated by a current flowing in opposite directions from the center region to opposing ends of the emission conductive plate 11 may be minimized. Accordingly, hardly any radio waves polarized parallel to the emission conductive plate 11 (horizontal polarization) are emitted, whereas radio waves polarized orthogonal to the emission conductive plate 11 (vertical polarization) are intensely emitted. Thus, the antenna system 10 exhibits high polarization purity. Since the antenna system 10 has very high gain for the vertical polarization, it may be used as a vehicle-mounted antenna. Furthermore, the antenna system 10 is easily formed by bending one metal plate, leading to reduced manufacturing costs.

Figure 3:
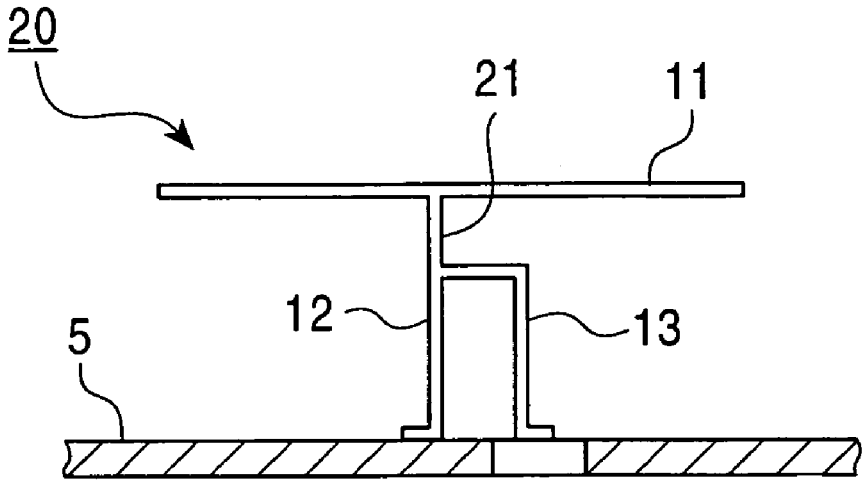
FIG. 3 is a side view-of an antenna system according to a second embodiment of the present invention.

FIG. 3 is a side view of an antenna system according to a second embodiment of the present invention. The same components as those of the first embodiment shown in FIGS. 1 and 2 are denoted by the same reference numerals.

An antenna system 20 shown in FIG. 3 includes an emission conductive plate 11, a common conductive plate 21, a short-circuiting conductive plate 12, and a power-supply conductive plate 13. The common conductive plate 21 is connected to the center region of the emission conductive plate 11, and the short-circuiting conductive plate 12 and the power-supply conductive plate 13 are connected to the common conductive plate 21. The common conductive plate 21 is used for both the short-circuiting conductive plate 12 and the power-supply conductive plate 13. The short-circuiting conductive plate 12 extends straight downward from the common conductive plate 21, and the power-supply conductive plate 13 branches off from the common conductive plate 21 and extends downward. Alternatively, the power-supply conductive plate 13 may extend straight downward from the common conductive plate 21, and the short-circuiting conductive plate 12 may branch off from the common conductive plate 21 and extend downward.

Figure 4:
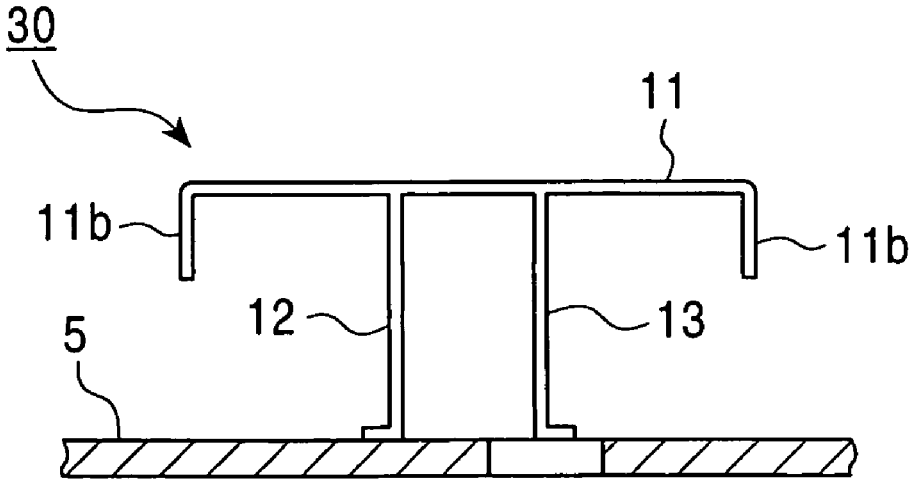
FIG. 4 is a side view of an antenna system according to a third embodiment of the present invention.

FIG. 4 is a side view of an antenna system according to a third embodiment of the present invention. The same components as those of the first embodiment shown in FIGS. 1 and 2 are denoted by the same reference numerals.

The structure of an antenna system 30 shown in FIG. 4 is the same as that of the antenna system 10 according to the first embodiment except that the emission conductive plate 11 has a bent portion 11*b* extending downward from at least a portion of the periphery thereof. This emission conductive plate 11 with the bent portion 11*b*, which is not parallel to the ground plane 5, has a reduced planar area, while having the same electrical length as an emission conductive plate without the bent portion 11*b*. Therefore, the antenna system 30 of the third embodiment may be miniaturized even further. The bent portion 11*b* may be provided substantially all around the periphery of the emission conductive plate 11. Further, the bent portion 11*b* may extend along the complete periphery of the emission conductive plate 11.

Figure 5:
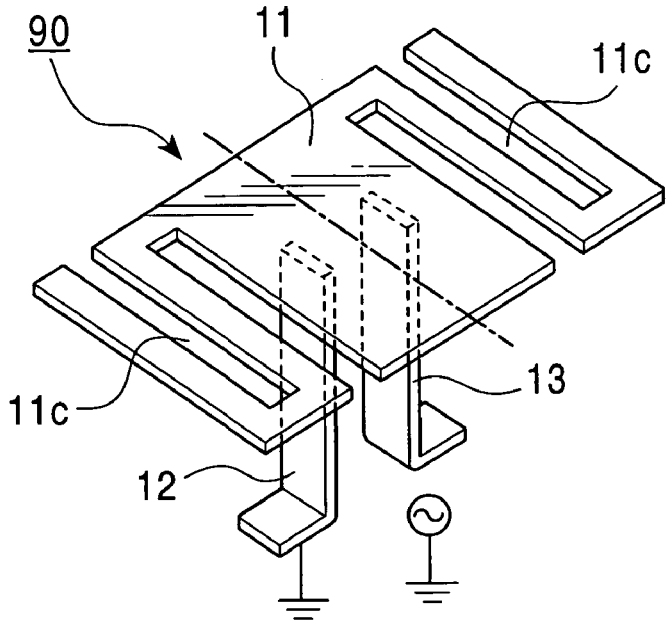
FIG. 5 is a perspective view of an antenna system according to a fourth embodiment of the present invention.

FIG. 5 is a perspective view of an antenna system according to a fourth embodiment of the present invention. The same components as those of the first embodiment shown in FIGS. 1 and 2 are denoted by the same reference numerals.

An antenna system 90 shown in FIG. 5 has a similar structure as the antenna system 10 according to the first embodiment and an emission conductive plate 11 has a substantially symmetric meandering-shape with respect to a centerline P, the emission conductive plate 11 having a plurality of cut-out sections 11*c*. With the meandering-shaped emission conductive plate 11, an electric current flows along the meander and thus the electrical length is longer, which may lead to further miniaturization.

With the first to fourth embodiments, since the emission conductive plate 11, the short-circuiting conductive plate 12, and the power-supply conductive plate 13 may be formed of one metal plate by bending, the antenna system is fabricated inexpensively. Alternatively, the emission conductive plate 11, the short-circuiting conductive plate 12, and the power-supply conductive plate 13 may be formed of two or three metal plates. In this case also, the antenna system may exhibit improved polarization purity.

Figure 6:
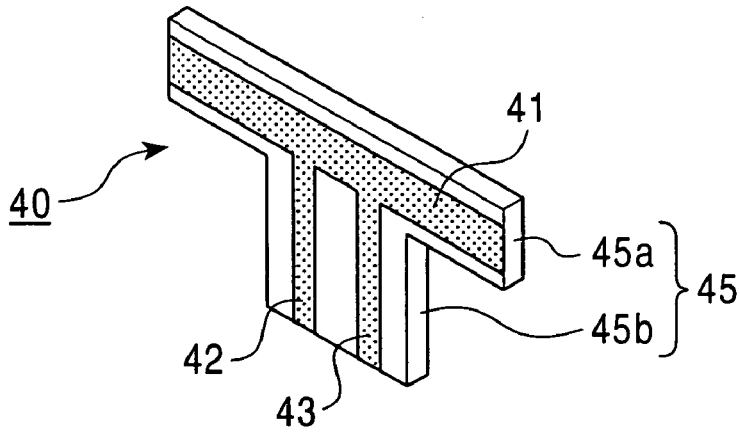
FIG. 6 is a perspective view of an antenna system according to a fifth embodiment of the present invention.

FIG. 6 is a perspective view of an antenna system according to a fifth embodiment of the present invention.

An antenna system 40 shown in FIG. 6 is composed of a T-shaped insulating base plate 45 made of synthetic resin. The insulating base plate 45 consists of a horizontal portion 45*a* and a leg 45*b* which extends downward from the center region of the horizontal portion 45*a*. A conductive layer with a pi (π) shape is formed on the insulating base plate 45. An emission conductive portion 41 is composed of a horizontal section of the conductive layer that is disposed on the horizontal portion 45*a* of the insulating base plate 45. A short-circuiting conductive portion 42 and a power-supply conductive portion 43 are composed of vertical sections of the conductive layer that are disposed on the leg 45*b*. The short-circuiting conductive portion 42 and the power-supply conductive portion 43 are separated parallel to each other at a predetermined distance. The top ends of the short-circuiting conductive member 42 and the power-supply conductive member 43 are connected to the center region of the emission conductive member 41. The antenna system 40 is mounted on a ground plane (not shown). The emission conductive member 41 is disposed parallel to the ground plane. The bottom end of the short-circuiting conductive member 42 may be soldered to the ground plane and the bottom end of the power-supply conductive member 43 may be connected to a power-supply circuit (not shown).

The antenna system 40 is composed of the insulating base plate 45 having the emission conductive member 41, the short-circuiting conductive member 42, and the power-supply conductive member 43 on the surface thereof. Accordingly, similar to the first to fourth embodiments, the antenna system 40 of the present invention is advantageously fabricated at reduced cost while having small dimensions. Furthermore, the antenna system 40 intensely emits radio waves polarized orthogonal to the emission conductive member 41 (vertical polarization) and thus has high polarization purity. Hence, the antenna system 40 may be suitable for mounting on vehicles.

Figure 7:
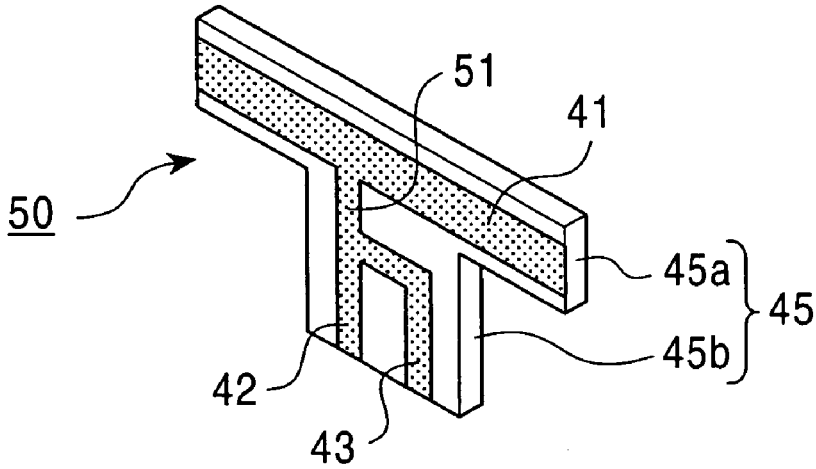
FIG. 7 is a perspective view of an antenna system according to a sixth embodiment of the present invention.

FIG. 7 is a perspective view of an antenna system according to a sixth embodiment of the present invention. The same components as those of the fourth embodiment shown in FIG. 6 are denoted by the same reference numerals.

According to an antenna system 50 shown in FIG. 7, a common conductive member 51 is connected to the center region of an emission conductive member 41, and a short-circuiting conductive member 42 and a power-supply conductive member 43 are connected to the common conductive member 51. The common conductive member 51 is used for both the short-circuiting conductive member 42 and the power-supply conductive member 43. The short-circuiting conductive member 42 extends straight downward from the common conductive member 51 and the power-supply conductive member 43 branches off from the common conductive member 51 and extends downward.

Alternatively, the power-supply conductive member 43 may extend straight downward from the common conductive member 51 and the short-circuit conductive member 42 may branch off from the common conductive member 51 and extend downward.

Figure 8:
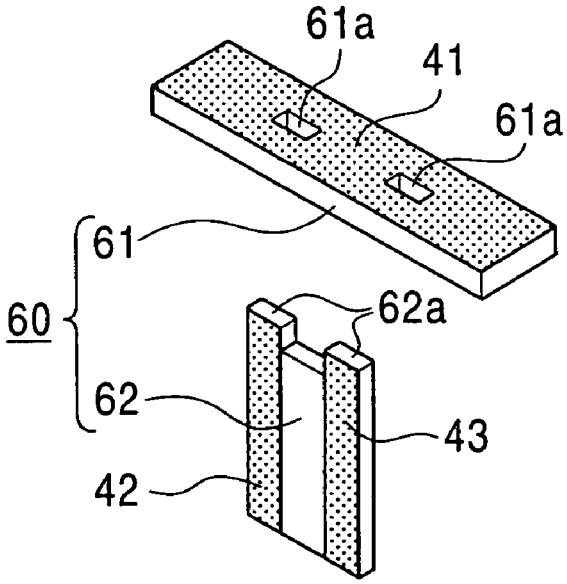
FIG. 8 is an exploded perspective view of an antenna system according to a seventh embodiment of the present invention.

FIG. 8 is an exploded perspective view of an antenna system according to a seventh embodiment of the present invention. The same components as those of the fourth embodiment shown in FIG. 6 are denoted by the same reference numerals.

A T-shaped antenna system 60 shown in FIG. 8 is composed of a first insulating base plate 61 and a second insulating base plate 62. The first insulating base plate 61 is made of synthetic resin and an emission conductive member 41 is formed on a surface thereof. The second insulating base plate 62 is made of synthetic resin, and a short-circuiting conductive member 42 and a power-supply conductive member 43 are formed on a surface thereof. A pair of holes 61*a* is disposed at the center region of the first insulating base plate 61 so as to pass therethrough. A pair of protrusions 62*a* is disposed on the top end of the second insulating base plate 62. The protrusions 62*a* are received in the holes 61*a* so that the first insulating base plate 61 is disposed horizontally and the second insulating base plate 62 is disposed vertically in the antenna system 60. The short-circuiting conductive member 42 and the power-supply conductive member 43 may be soldered to the center region of the emission conductive member 41. The antenna system 60 of the seventh embodiment has a structure in which the emission conductive member 41 in the antenna system 40 of the fifth embodiment faces upward.

Figure 9:
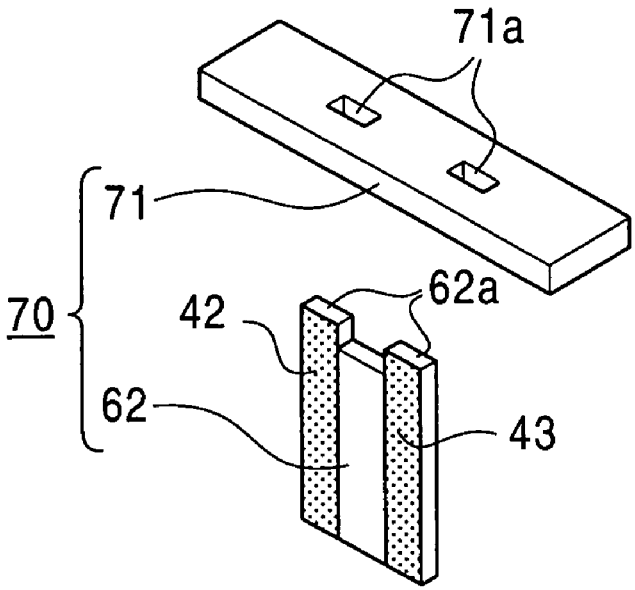
FIG. 9 is an exploded perspective view of an antenna system according to an eighth embodiment of the present invention.

FIG. 9 is an exploded perspective view of an antenna system according to an eighth embodiment of the present invention. The same components as those of the sixth embodiment shown in FIG. 8 are denoted by the same reference numerals.

An antenna system 70 shown in FIG. 9 has the same structure as the antenna system 60 of the seventh embodiment except that a metal plate 71 functions as the emission conductive member. The metal plate 71 is connected to a second insulating base plate 62. The metal plate 71 is horizontally disposed and the second insulating base plate 62 is vertically disposed in the antenna system 70. A pair of holes 71*a* passes through the center region of the metal plate 71 and receives a pair of protrusions 62*a* of an insulating base plate 62. A short-circuiting conductive member 42 and a power-supply conductive member 43 may be soldered to the center region of the metal plate 71, that is, the emission conductive member.

Figure 10:
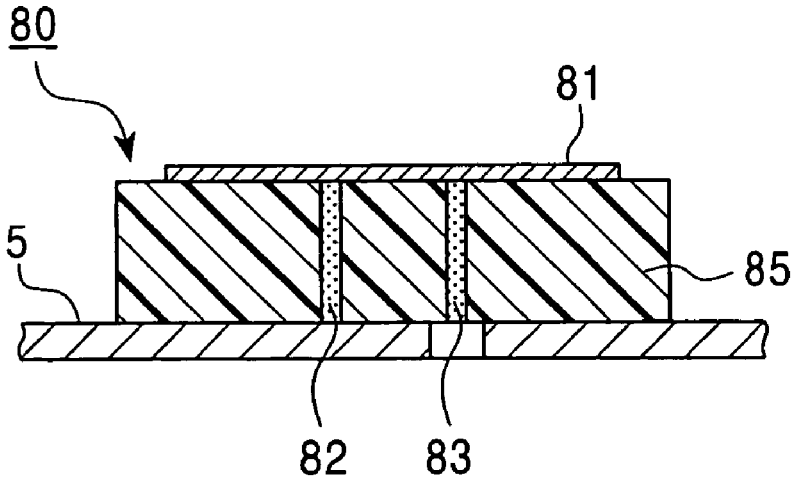
FIG. 10 is a cross-sectional view of an antenna system according to a ninth embodiment of the present invention.
Figure 11:
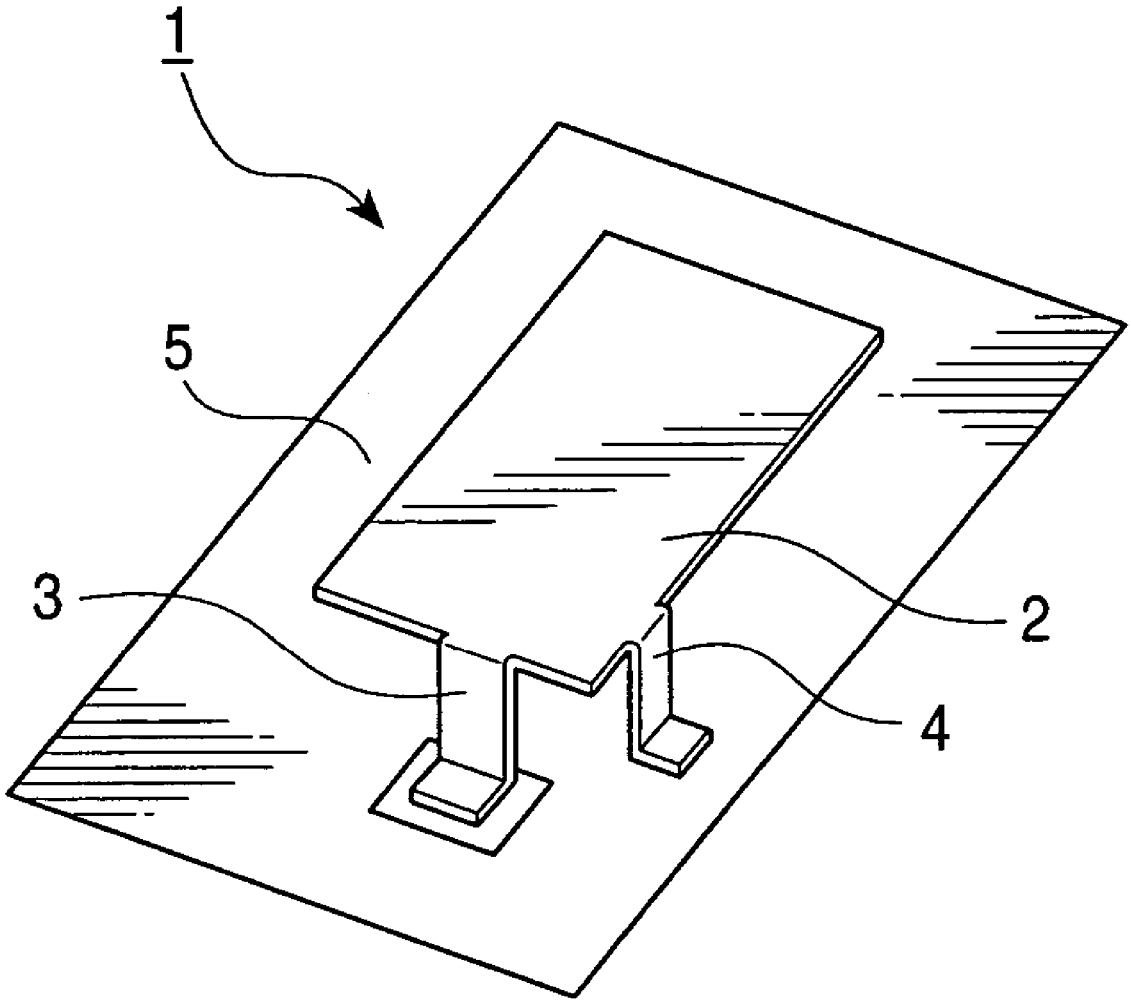
FIG. 11 PRIOR ART
FIG. 11 is a perspective view of a known inverted F antenna.

FIG. 10 is a cross-sectional view of an antenna system according to a ninth embodiment of the present invention.

An antenna system 80 shown in FIG. 10 includes a thick insulating base plate 85, an emission conductive member 81, a short-circuiting conductive pin 82, and a power-supply conductive pin 83. The emission conductive member 81 is composed of a conductive layer formed on the top surface of the insulating base plate 85. The short-circuiting conductive pin 82 and the power-supply conductive pin 83 pass through the insulating base plate 85. The short-circuiting conductive pin 82 and the power-supply conductive pin 83 are separated parallel to each other at a predetermined distance. The top ends of the short-circuiting conductive pin 82 and the power-supply conductive pin 83 may be soldered to the center region of the emission conductive member 81. The antenna system 80 is mounted on a ground plane 5. The emission conductive member 81 is disposed parallel to the ground plane 5. The bottom end of the short-circuiting conductive pin 82 may be soldered to the ground plane 5 and the bottom end of the power-supply conductive pin 83 is connected to a power-supply circuit (not shown).

Although the description of the antenna has been approached from the viewpoint of a transmitting application, it is equally possible to use the embodiments and the teachings to receive electromagnetic waves in accordance with the principle of reciprocity. As such, the power supply (feeding) conductive member may be connected to the input of a sensor, which may be a radio receiver, a transceiver or a power measuring apparatus. The radiation pattern characteristics and advantages will be similar, as will be appreciated by one skilled in the art.

Embodiments of the invention have been described having components made of metal sheet, and of metallic layers deposed on insulating substrates. Equally, the individual components may be constructed utilizing either method and combined with each other to realize any of the embodiments described and variants thereof.

The insulating substrate material may be ceramic, resin, fiber-reinforced resin or any other low-loss electrical material having suitable mechanical and durability properties.

When the joining of component parts is needed, in addition to soldering, welding, conductive adhesives or cements may be used.

Although only a few exemplary embodiments of this invention have been described in detail above, those skilled in the art will readily appreciate that many modifications are possible in the exemplary embodiments without materially departing from the novel teachings and advantages of the invention.

What is claimed is:

1. An antenna system comprising:

a ground plane;

an emission conductive member disposed substantially parallel to the ground plane;

a short-circuiting conductive member having a first end and a second end; and a feeding conductive member having a first end and a second end, wherein the first end of the short-circuiting conductive member and the first end of the feeding conductive member are connected to a center region of the emission conductive member, the second end of the short-circuiting conductive member is connected to the ground plane, the second end of the feeding conductive member is connected to at least one of a power-supply circuit or a sensor, and the short-circuiting conductive member is configured to fix the distance between the emission conductive member and the ground plane.

2. The antenna system according to claim 1, wherein the connections of short-circuiting conductive member and the feeding conductive member with the emission conductive member are disposed with a separation therebetween at the center region of the emission conductive member.

3. The antenna system according to claim 1, further comprising a common conductive member that is connected to the center region of the emission conductive member, wherein the first end of the short-circuiting conductive member and the first end of the feeding conductive member are connected to the common conductive member.

4. The antenna system according to claim 3, wherein the emission conductive member has bent portions on at least a part of the periphery thereof, the bent portions being substantially non-parallel to the ground plane.

5. The antenna system according to claim 3, wherein the emission conductive member has bent portion on opposing peripheral ends thereof, the bent portions being substantially non-parallel to the ground plane.

6. The antenna system according to claim 3, wherein the emission conductive member has bent portions on substantially all of the periphery thereof, the bent portions being substantially non-parallel to the ground plane.

7. The antenna system according to claim 1, wherein the emission conductive member has a bent portion on at least a part of a periphery thereof, the bent portion being non-parallel to the ground plane.

8. The antenna system according to claim 7, wherein the emission conductive member has bent portions on opposing peripheral ends thereof, the bent portions being substantially non-parallel to the ground plane.

9. The antenna system according to claim 7, wherein the emission conductive member has bent portions on substantially the entire periphery thereof, the bent portions being substantially non-parallel to the ground plane.

10. The antenna system according to claim 1, wherein the emission conductive member has a substantially symmetric meandering-shape with respect to the center region.

11. The antenna system according to claim 10, wherein the emission conductive member has a plurality of cut-out sections.

12. The antenna system according to claim 1, wherein the emission conductive member, the short-circuiting conductive member, and the feeding conductive member comprise at least one metal plate.

13. The antenna system according to claim 12, wherein the emission conductive member, the short-circuiting conductive member, and the feeding conductive member are co-planar.

14. The antenna system according to claim 12, wherein the short-circuiting conductive member and the feeding conductive member comprise bent segments at a center region of a first metal plate and the emission conductive member comprises a second metal plate.

15. The antenna system according to claim 12, wherein the emission conductive member, the short-circuiting conductive member, and the feeding conductive member comprise a plurality metal plates.

16. The antenna system according to claim 1, further comprising at least one insulating substrate having at least one conductive layer on a surface thereof, wherein the conductive layer functions as at least one of the emission conductive member, the short-circuiting conductive member, the feeding conductive member and the ground plane.

17. The antenna system according to claim 16, wherein the emission conductive member, the short-circuiting conductive member, and the feeding conductive member are co-planar.

18. The antenna system according to claim 17, wherein said at least one insulating substrate is an insulating substrate.

19. The antenna system according to claim 17, wherein said at least one insulating substrate comprises at least two insulating substrates.

20. The antenna system according to claim 1, further comprising a metal plate and an insulating substrate connected to each other, the insulating substrate including a conductive layer on a surface thereof, and the metal plate and the conductive layer function as the emission conductive member, the short-circuiting conductive member, and the feeding conductive member.

21. The antenna system according to claim 1, further comprising an insulating substrate having a conductive layer on a surface thereof and conductive pins passing through the insulating substrate, wherein the conductive layer functions as the emission conductive member, and the conductive pins function as the short-circuiting conductive member and the feeding conductive member.

22. The antenna system according to claim 1, wherein the second end of the feeding conductive member is connected to a power supply circuit.

23. The antenna system according to claim 22, wherein the power supply circuit is a radio transmitter.

24. The antenna system according to claim 22 where the power supply is a radio transceiver.

25. The antenna system according to claim 1, wherein the second end of the feeding conductive member is connected to a sensor.

26. The antenna system according to claim 25, wherein the sensor is a radio receiver.

27. The antenna system according to claim 25 where the sensor is a radio transceiver.

28. The antenna system of claim 1, wherein at least one of the short-circuiting conductive member or the feeding conductive member is formed integrally with the emission conductive member.

29. An antenna system, comprising:

a ground plane means for at least one of emitting and receiving electromagnetic waves;

means for feeding connected to the means for emitting electromagnetic waves at a central region thereof and to at least one of a power supply or a sensor; and means for short circuiting the means for emitting electromagnetic waves to the ground plane, wherein the means for short circuiting spaces the means for emitting electromagnetic waves from the ground plane.

30. A method of at least one of radiating and receiving electromagnetic waves of predominantly one polarization, comprising:

providing a ground plane;

providing an emission conductive member disposed substantially parallel to the ground plane;

providing a short-circuiting conductive member having a first and second end, the short-circuiting conductive member spacing the emission conductive member from the ground plane;

providing a feeding member having a first and second end;

connecting the first end of the short-circuiting conductive member and the first end of the feeding conductive member to a center region of the emission conductive member;

connecting the second end of the short-circuiting conductive member to the ground plane;

connecting the second end of the feeding conductive member to at least one of a power supply or a sensor.

* * * * *